US005091749A

United States Patent [19]

Iida et al.

[11] Patent Number: 5,091,749

[45] Date of Patent: Feb. 25, 1992

[54] TONER CONTENT CONTROL APPARATUS

[75] Inventors: Masaru Iida, Kawasaki; Yoshihiro Tonomoto, Yokohama, both of Japan

[73] Assignee: Fujitsu Limited, Kanagawa, Japan

[21] Appl. No.: 542,224

[22] Filed: Jun. 22, 1990

[30] Foreign Application Priority Data

Jul. 6, 1989 [JP] Japan ..... 1-175181

[51] Int. Cl.[5] ..... G03G 21/00

[52] U.S. Cl. ..... 355/246; 355/208; 118/689

[58] Field of Search ..... 355/246, 208, 203, 204; 118/689-691

[56] References Cited

U.S. PATENT DOCUMENTS

| | | | |
|---|---|---|---|
| 4,468,112 | 8/1984 | Suzuki et al. | 118/689 X |
| 4,592,645 | 6/1986 | Kanai et al. | 118/689 X |
| 4,916,488 | 4/1990 | Kimura | 355/208 |
| 4,980,727 | 12/1990 | Stelter | 355/246 |

FOREIGN PATENT DOCUMENTS

| | | | |
|---|---|---|---|
| 3906885 | 9/1989 | Fed. Rep. of Germany | 355/246 |
| 0303381 | 12/1988 | Japan | 355/246 |

*Primary Examiner*—A. T. Grimley
*Assistant Examiner*—Matthew S. Smith
*Attorney, Agent, or Firm*—Armstrong, Nikaido, Marmelstein, Kubovcik & Murray

[57] ABSTRACT

A toner content control apparatus senses the toner content of developer in a developer station, and performs toner content control by replenishing the consumed toner in the developer station according to the result of a comparison between the sensed toner content and the predesignated standard value. The toner content control apparatus of the present invention is realized by providing a toner content sensor having a sensitivity control circuit. A controller, when the developer is changed, determines an optimum sensor sensitivity control data with which the sensor gives an optimum sensitivity. The controller outputs sensor sensitivity control data to the sensitivity control circuit and updates the sensor sensitivity control data by reducing or increasing the data by a correction value according to whether the difference between the output data of the sensor and the predesignated reference value is positive or not. The controller also determines an optimum sensor sensitivity control data by using the updated sensor sensitivity control data and by halving the correction value until the difference comes within the predesignated allowable error. The controller also performs toner content control with the determined sensitivity control data set in the sensitivity control circuit.

8 Claims, 8 Drawing Sheets

FIG.1(a) RELATED ART
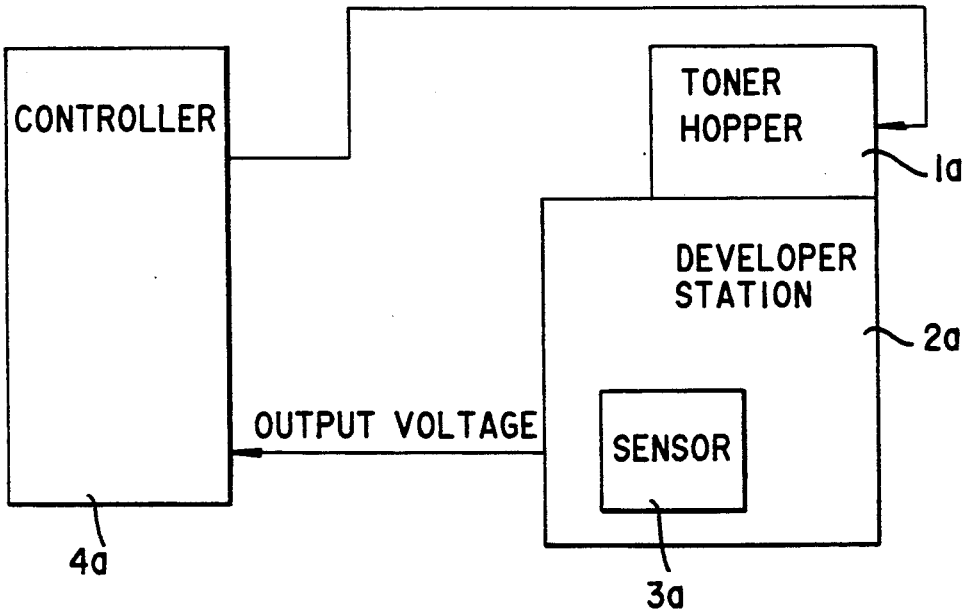
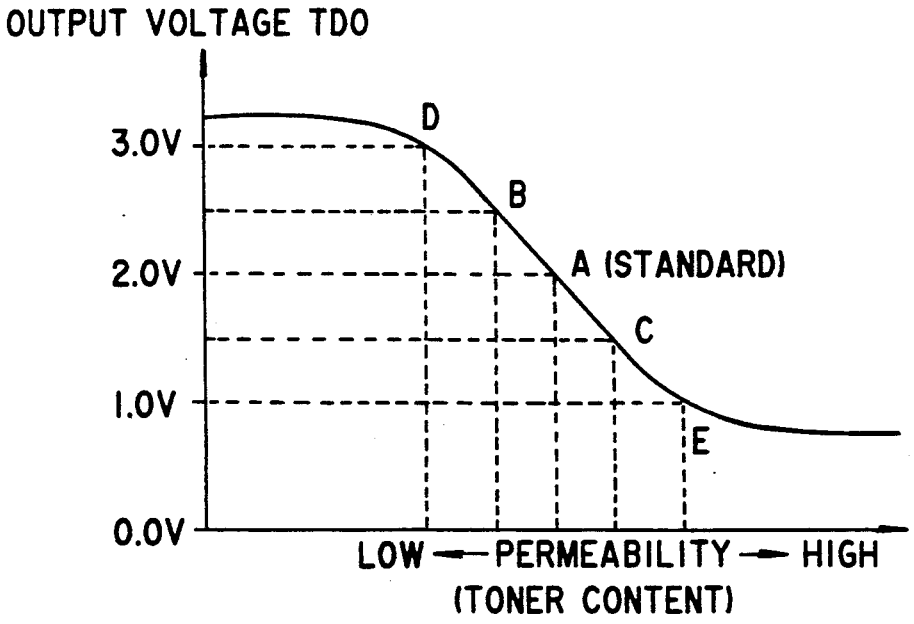
FIG.1(b)

TONER CONTENT CONTROL APPARATUS

BACKGROUND OF THE INVENTION

1. Field of the Invention

The present invention relates to toner content control of an image forming apparatus such as a laser beam printer.

In an electrophotographic or electrostatic recording unit, a developing unit is used to visualize (develop) an electrostatic latent image formed on a photosensitive plate or drum surface. In a developing unit using powder developer, especially developer consisting of a mixture of toner and carrier, it is necessary to sense the toner content of the developer correctly and control toner content by replenishing the toner consumed in the process of printing. Therefore, it is necessary to sense toner content of the developer correctly even for different kinds of developer to replenish correct amount of toner and to attain proper density of printing.

2. Description of the Related Art

FIG. 1(*a*) shows a block diagram of a developing unit of a related art of the present invention.

Controller 4*a* reads the sensor output voltage (called TDO hereafter) of a toner content sensor (called simply sensor hereafter) 3*a* which is provided in developer station 2*a* and compares TDO with the predesignated standard voltage to check to see if toner content is proper. If the toner content is less than predesignated amount, controller 4*a* controls toner hopper la to replenish developer station 2*a* with toner.

Sensor 3*a*, which senses toner content by measuring permeability of developer consisting of carrier and toner, gives permeability-output voltage (TDO) characteristics as shown in FIG. 1(*b*). When sensor 3*a* outputs 2.0 volts for desired toner content, 2.0 volts is designated as the standard voltage, that is, the toner content is high or low depending on whether sensor 3*a* outputs a voltage more or less than 2.0 volts, respectively. Meanwhile, developer is changed due to the degradation of carrier, that is, when carrier particle is deformed or becomes insufficiently charged. However, the developer may have different magnetic characteristics or offer different permeability for the same toner content. That is, sensor 3*a* may have TDO at point B or C, or sometimes D or C in FIG. 1(*b*) even for developer with the standard toner content. To overcome this problem, the conventional developing unit reads TDO of sensor 3*a* every time developer is changed and designated the TDO as the standard voltage (See, for example, Laid Opened Japanese Patent TOKUKAISHO 64-5299). However, if the standard value is designated at the above mentioned D or C, which is out of the linear portion of the characteristic curve, sensor 3*a* gives TDO voltage unproportional to the decrease in toner content and is apt to be influenced by noises, and therefore, preventing controller 4*a* from proper toner content control.

SUMMARY OF THE INVENTION

An object of the present invention is to control toner content of a developer properly to attain proper density of printing.

Another object of the present invention is to sense correctly toner content even for different kinds of developer.

The above objects are accomplished by providing a toner content sensor having a sensor sensitivity control circuit, and a controller which determines an optimum sensor sensitivity control data when the developer is changed. Thus, the sensor can sense the toner content correctly with the determined sensitivity control data set in the sensor sensitivity control circuit, and the controller can replenish the consumed toner properly.

BRIEF DESCRIPTION OF THE DRAWINGS

FIG. 1(*a*) is a block diagram of a related art of the present invention.

FIG. 1(*b*) shows the permeability-output voltage characteristics of a sensor.

FIG. 5(*b*) shows the characteristics of an analog-to-digital converter.

FIG. 8(*b*) shows the input-output voltage characteristics of the sensor illustrating the embodiment of the present invention.

Throughout the above-mentioned drawings, identical reference numerals designate the same or similar component parts.

DESCRIPTION OF THE PREFERRED EMBODIMENT

Figure 2:
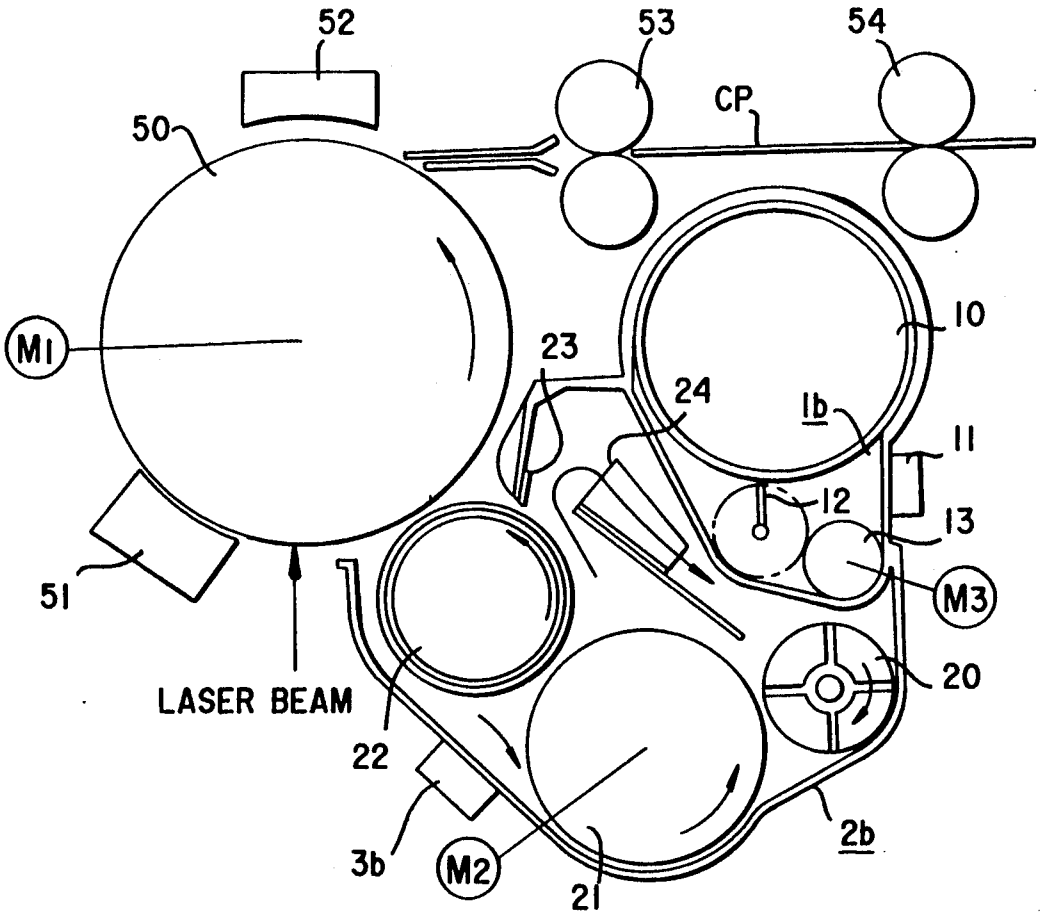
FIG. 2 is a schematic cross sectional view of the developing unit of the present invention.

In FIG. 2, motor Ml rotates photoconductor drum 50 in the direction shown by the arrow. Prior to printing, pre-charger 51 uniformly charges the photosensitive surface of photoconductor drum 50 positively, for example. When a laser beam modulated by print information is applied, the charged surface of photoconductor drum 50 becomes less resistive and is discharged. That is, the electric potential of irradiated areas of the drum surface drops, thus exposing an electrostatic latent image onto photoconductor drum 50. In developer station 2*b*, magnetic roller 22 applies toner to the exposed surface of photoconductor drum 50 to develop the print information. Transfer charger 52 attracts electrostatically toner from photoconductor drum 50 to the recording paper CP to transfer the image developed on the drum surface onto recording paper CP, which is fed in through rollers 53 and 54. Finally, the toner on recording paper CP is fused in the not-depicted fuser station to complete printing.

In toner hopper 1*b*, a toner cartridge containing toner is put in cartridge mount 10. Toner quantity sensor 11 detects that a certain quantity of toner is in toner hopper 1*b*. Agitator 12 stirs the toner in toner hopper 1*b*. Toner feed roller 13, rotated by feed motor M3, feeds the toner from toner hopper 1*b* to developer station 2*b*.

In developer station 2*b*, roller 20 mixes the developer, a mixture of toner and carrier. Roller 21 dips up the developer from the bottom of developer station 2*b*. Thus, the toner is charged positively, for example, while being agitated by rollers 20 and 21. Magnetic roller 22 forms a magnetic brush on its surface and deposits the developer on photoconductor drum 50 to develop electrostatic latent image on the drum surface. Doctor blade 23 adjusts the thickness of the developer on magnetic roller 22 by scraping excess developer. Plate 24 guides the developer scraped by doctor blade 23 toward roller 20. Motor M2 rotates rollers 21, 22 and 20.

Figure 3:
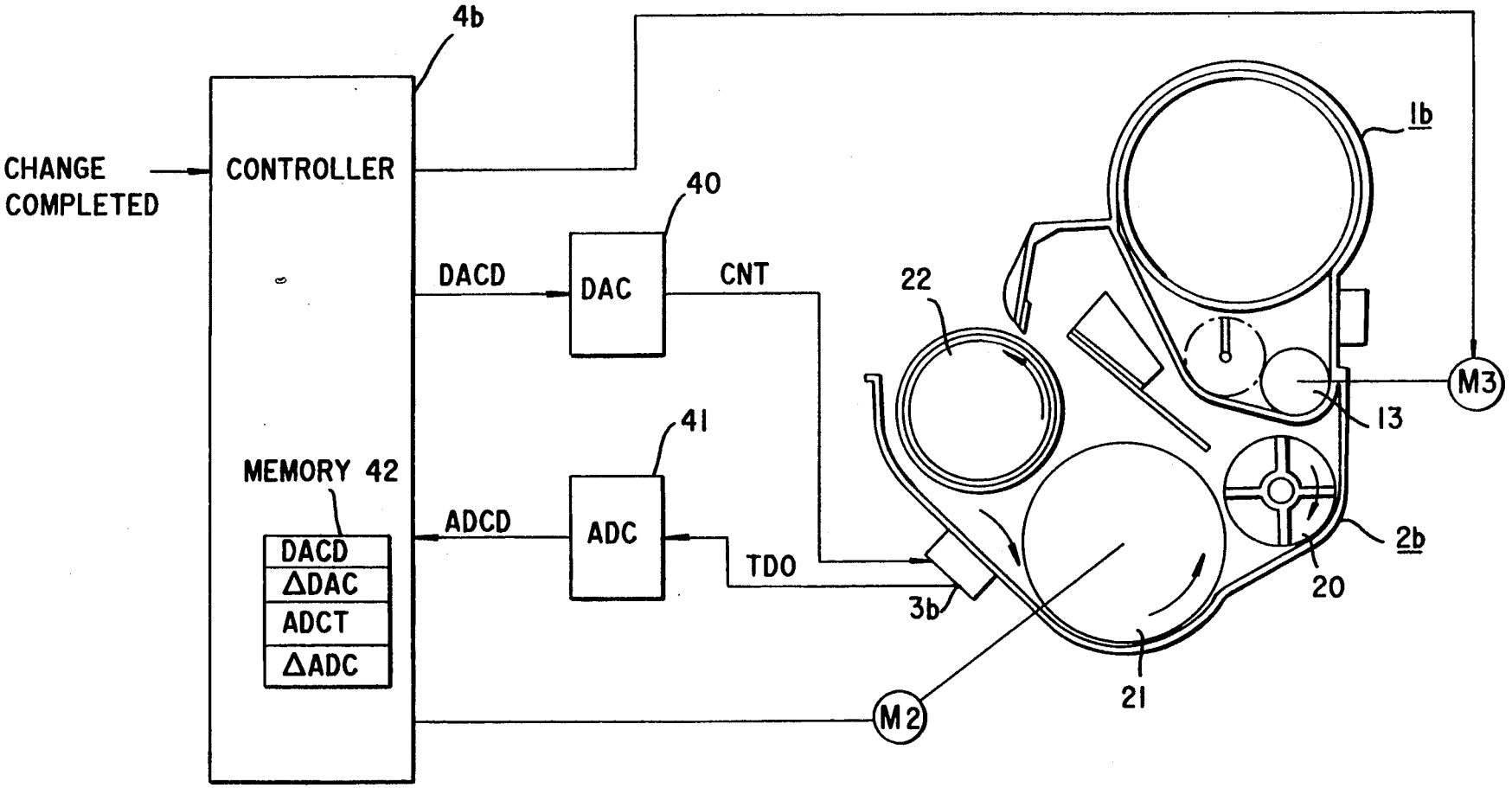
FIG. 3 is a block diagram illustrating the toner content control method of the present invention.
Figure 4:
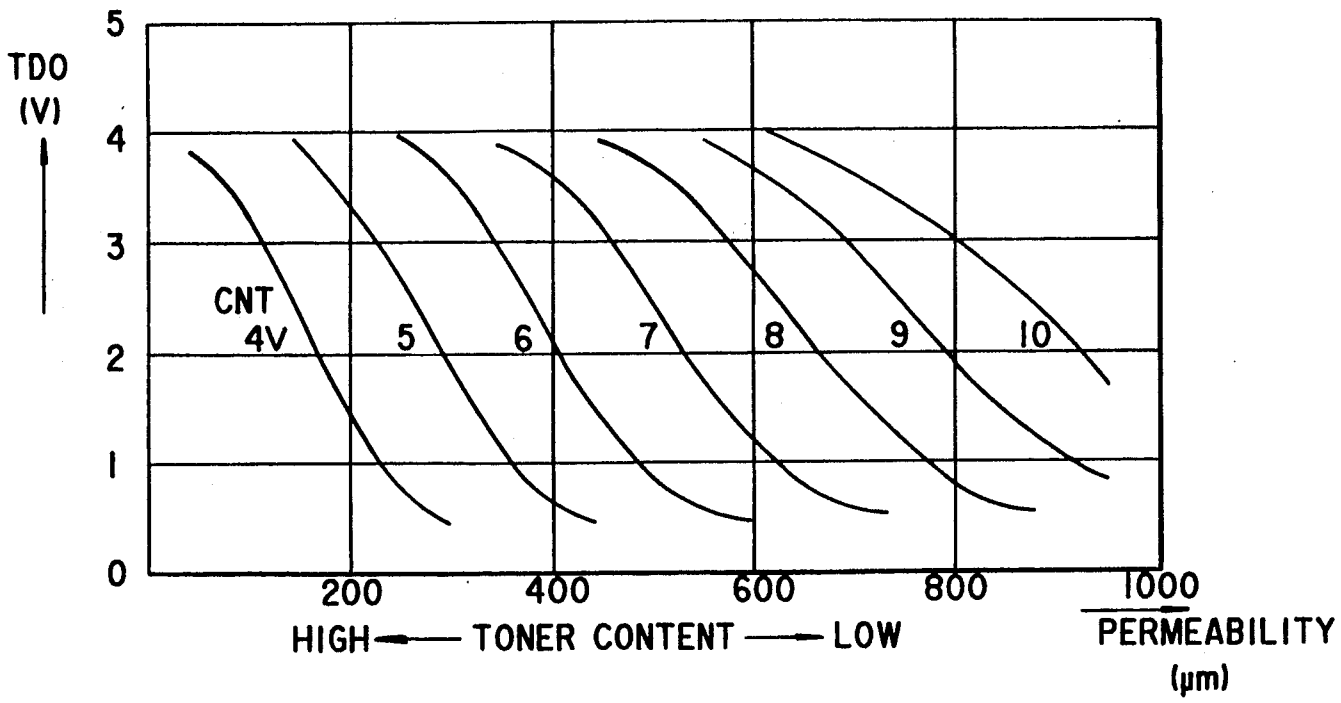
FIG. 4 shows the permeability-output voltage characteristics of a sensor.

In FIG. 3, toner content sensor (called simply sensor hereafter) **3*b* which has a built-in transformer for measuring the permeability of developer and for controlling sensor sensitivity, is provided under magnetic roller 22 to sense toner content. Sensor 3*b* senses toner content by giving the sensor output voltage (called TDO hereafter) according to the change in transformer inductance which reflects the permeability of developer. Sensor 3*b* is also capable of controlling sensor sensitivity by changing the sensitivity control voltage (called CNT hereafter) to be applied to the transformer and thus, changing TDO accordingly. (Confer, for example, programmable toner sensor TS0512LB-9 manufactured by TDK, Japan.) As shown in FIG. 4, sensor 3*b*** gives different permeability-output voltage (TDO) characteristics depending on CNT to be applied.

Controller **4*b*, consisting of a microprocessor, random access memory RAM, read-only memory ROM, etc., executes the program stored in the ROM to control the sensitivity of sensor 3*b*, which is a feature of the present invention, and to control toner content according to TDO of sensor 3*b***.

Figure 5A:
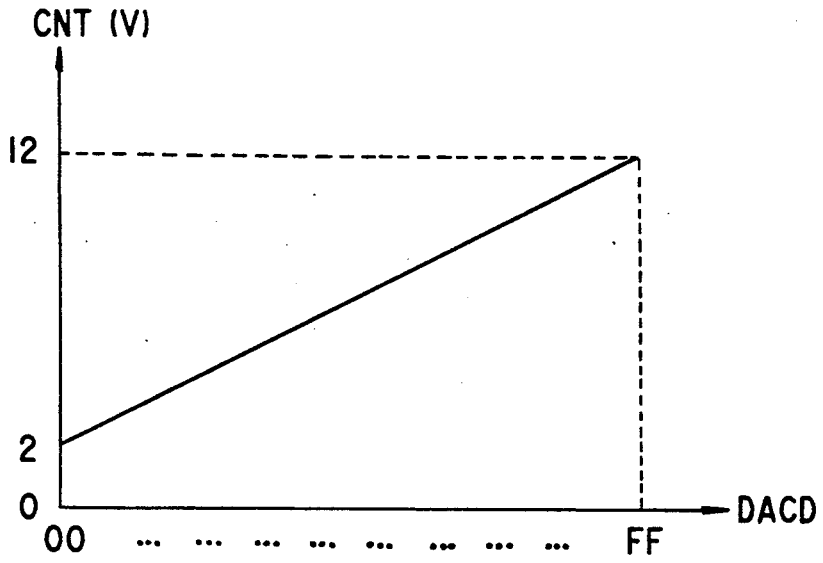
FIG. 5(*a*) shows the characteristics of a digital-to-analog converter.
Figure 5B:
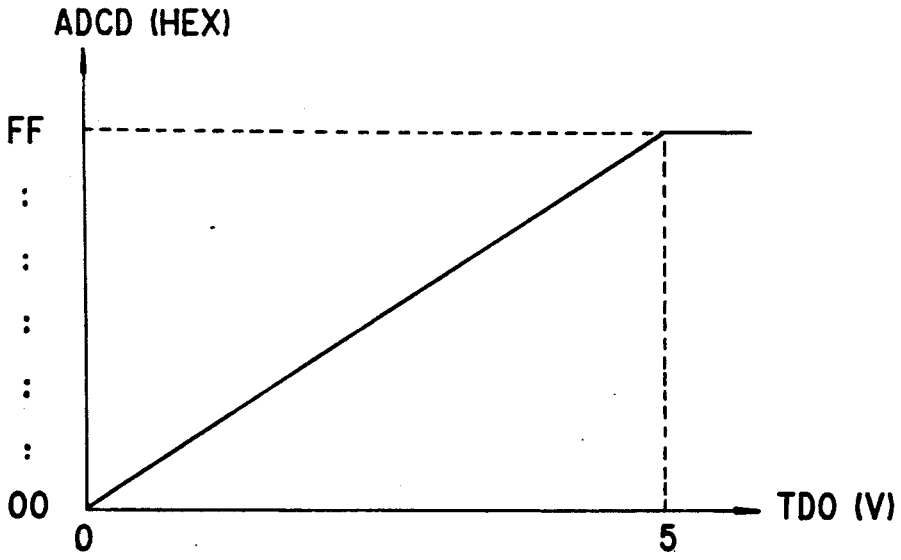

Digital-to-analog converter (called DAC hereafter) 40 converts digital 8-bit data representing sensitivity control data (called DACD hereafter) from controller **4*b* to analog sensitivity control voltage CNT to output to sensor 3*b*. As shown in FIG. 5** (*a*), DAC 40 converts 8-bit data (DACD) ranging from "$ 00" to "$ FF" to voltage (CNT) ranging from 2 to 12 volts, respectively. Hence, a hexadecimal (abbreviated as hex) number n is indicated by "$ n" hereafter.)

Analog-to-digital converter (called ADC hereafter) 41 converts analog sensor output voltage TDO from sensor **3*b* to digital 8-bit sensor output data (called ADCD hereafter) to output to controller 4*b*. As shown in FIG. 5** (*b*), ADC 41 converts voltage (TDO) ranging from 0 to 5 volts to 8-bit data (ADCD) ranging from "$ 00"to "$ FF", respectively.

Memory 42 stores values required to control the sensitivity of sensor **3*b*** and to control toner content, such as the reference value ADCT, sensitivity control data DACD, correction value ΔDAC and allowable error ΔADC. Reference ΔADCT is used for determining the optimum sensor sensitivity and for adjusting toner content.

Figure 6:
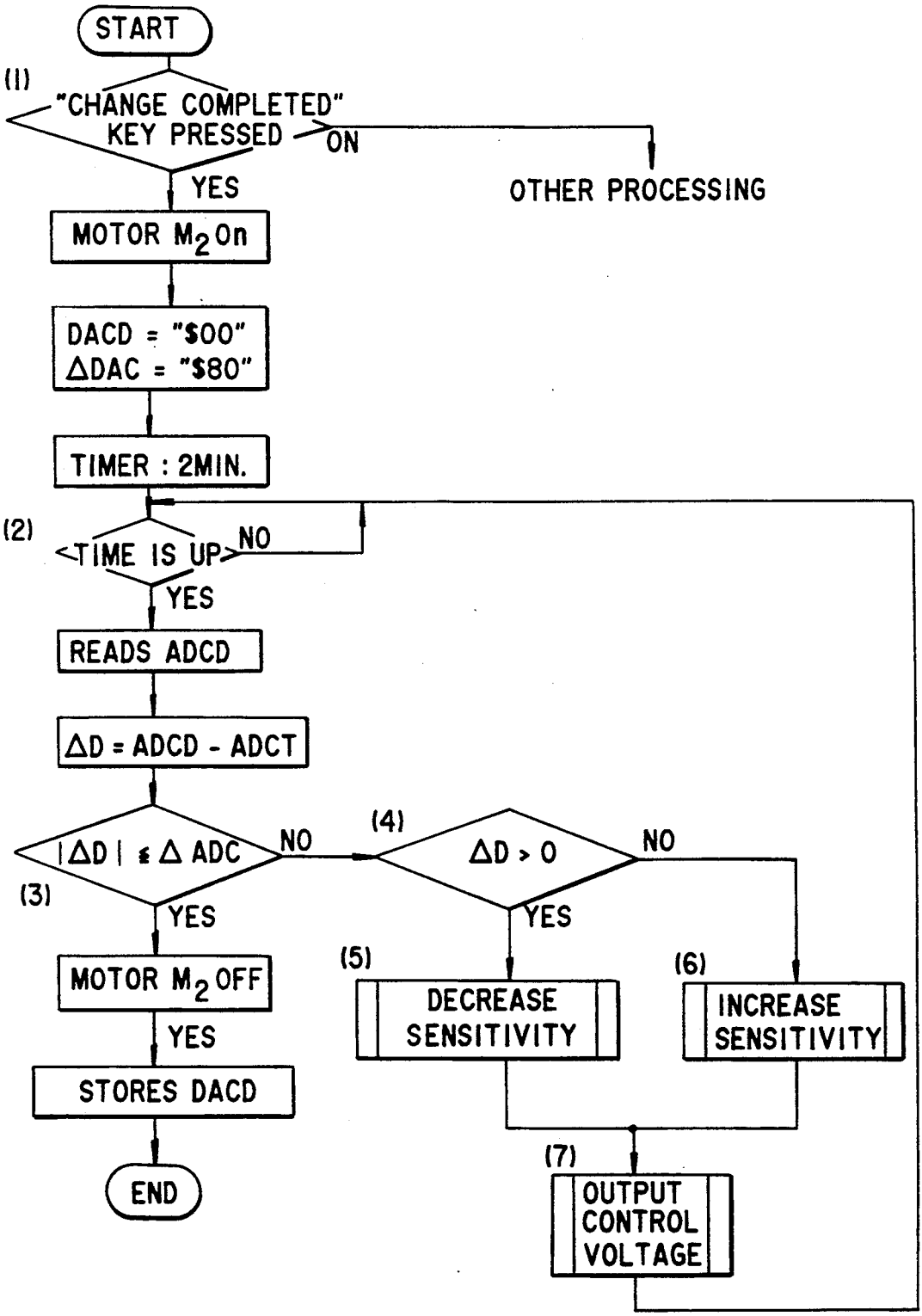
FIG. 6 is a flowchart illustrating sensor sensitivity control of the present invention.
Figure 7C:
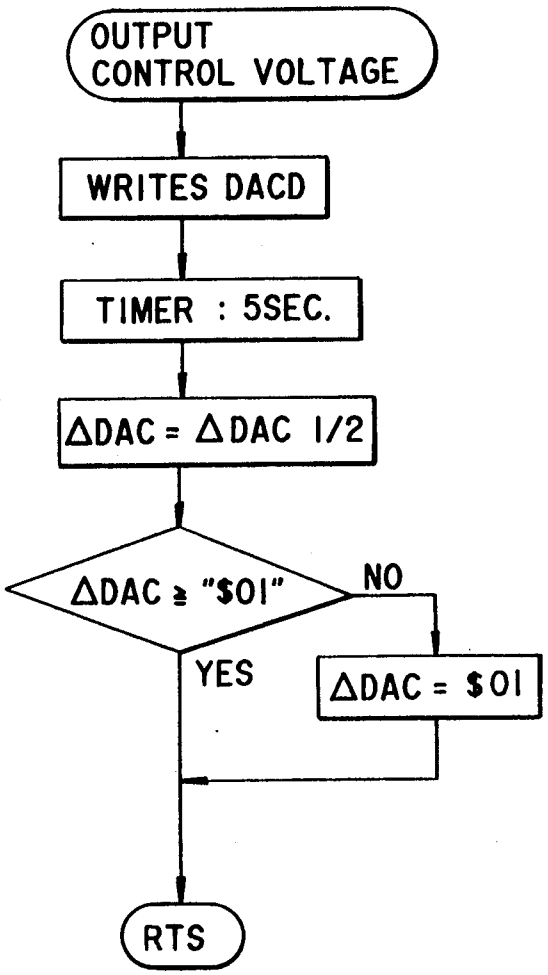
FIGS. 7(*a*), (*b*) and (*c*) are the flowcharts of the subroutines in FIG. 6.
Figure 7B:
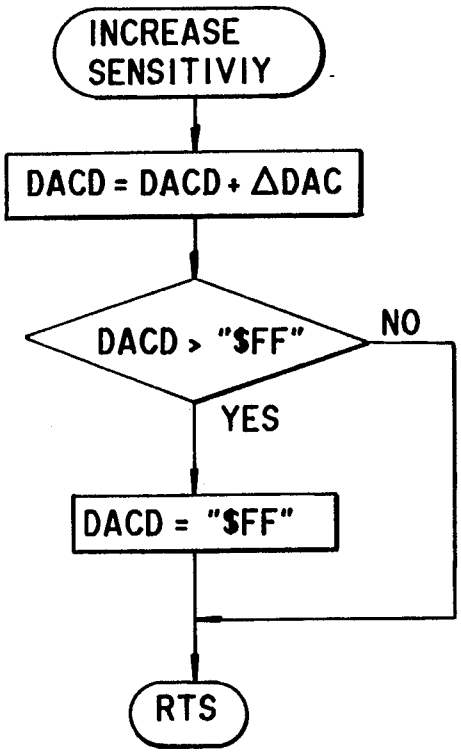
Figure 7A:
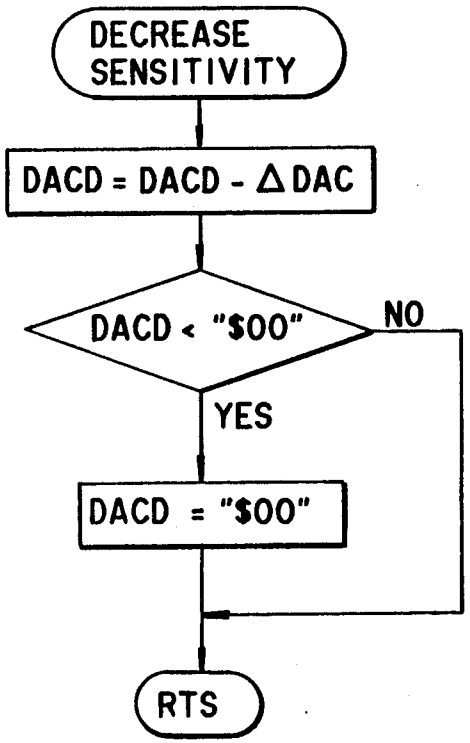

In reference to FIGS. 6 and 7, a sensor sensitivity control is performed by the following steps (1)–(7):

(1) After changing the developer, the operator presses the "Change Completed" key on the not-depicted operator panel. On detecting the key pressed, controller **4*b* starts the "Sensitivity Control" processing": First, motor M2 is started and rollers 20, 21 and 22 are rotated to stir the developer in developer station 2*b* so that the developer may flow on the sensor surface where sensor 3*b* senses toner content. Second, the initial value of DACD is set to "$ 00" (i.e. CNT is set to 2.0 volts) and written in DAC 40. The correction value ΔDAC is set to "$ 80" (a half of the variable input range of DAC 40), which is added to or subtracted from DACD to correct DACD for use at the next time when a desired ADCD is not obtained from sensor 3*b* via ADC 41. The reference value ADCT is stored in the ADCT area of memory 42. Third, controller 4*b* starts the built-in timer (not depicted in the figure) designating 2 minutes, in which time to read sensor 3*b***.

(2) When the time designated in the timer has elapsed, ADCD is read from ADC 41, which is analog-to-digital converted output of sensor **3*b***. Next, the reference value ADCT is subtracted from ADCD and the absolute value of the difference $|\Delta D|$ is compared with the allowable error ΔADC.

(3) When $|\Delta D|$ is equal to or smaller than ΔADC, which means that $|\Delta D|$ is within the allowable error, controller **4*b* stops operating developer station 2*b* by turning off motor M2, stores the current DACD in the DACD area of memory 42** for use as the sensitivity control data and stores the current ADCD in the ADCT area for use in measuring toner content.

(4) When $|\Delta D|$ is greater than ΔADC, controller **4*b*** checks to see if ΔD is more or less than zero.

(5) When ΔD is greater than zero, controller **4*b* executes the "/Decrease Sensitivity" subroutine in FIG. 7**(*a*). The correction value ΔDAC is subtracted from DACD to obtain a difference. If the difference is less than minimum "$ 00", "$ 00" is selected and otherwise, the difference is selected as a new DACD to store in memory 42. Then, controller **4*b*** returns from the subroutine (RTS).

(6) On the other hand, when ΔD is equal to or less than zero, controller **4*b* executes the "Increase Sensitivity" subroutine in FIG. 7**(*b*).

ΔDAC is added to DACD to obtain a sum. If the sum is greater than maximum "$ FF", "$ FF" is selected and otherwise, the sum is selected as a new DACD to store in memory 42. Then, controller 4b returns from the subroutine (RTS).

(7) After executing the subroutine in step (5) or (7), controller **4*b*** executes the "Output Control Voltage" subroutine:

The new DACD is written in DAC 40 to apply CNT to sensor **3*b*. The timer is started designating 5 seconds, in which time to read sensor 3*b*. This is because, after changing sensor sensitivity, about 5 seconds is required to have a stable sensor output due to the sensor peripheral circuits. Next, the current correction value ΔDAC is divided by 2 to compare the quotient ΔDAC/2 with the minimum of correction value "$ 01". If ΔDAC/2 is less than "$ 01", "$ 01" and otherwise, ΔDAC/2 is stored in memory 42 as a new correction value. Then, controller 4*b*** returns from the subroutine (RTS).

In brief, controller **4*b* outputs a certain value for the sensitivity control data DACD and reads the sensor output data ADCD. If ADCD is greater than the allowable error ΔADC, controller 4*b* decreases DACD by the correction value ΔADC to make correction and otherwise, increases DACD by ΔDAC. After outputting the DACD corrected this way to sensor 3*b*, controller 4*b* reads ADCD again. Thus, controller 4*b*** determines DACD to be used as the sensor sensitivity data and as the reference value in adjusting toner content, by repeating the above processing until the difference between ADCD and ADCT comes within the allowable error ΔADC.

The following is an example to obtain an optimum sensor sensitivity for a developer (whose permeability is actually 400 μm), i.e., CNT which causes the center of the linear portion of the characteristic curve to come to 2.0 volts in FIG. 4. In FIG. 1(*b*) or FIG. 4, the standard TDO value of sensor 3*b* is 2.0 volts, which is "$ 65" according to FIG. 5(*b*), and the reference value ADCT is designated to be "$ 65". The allowable error ΔADC is tentatively set to be "$ 05" in this example.

Figure 8A:
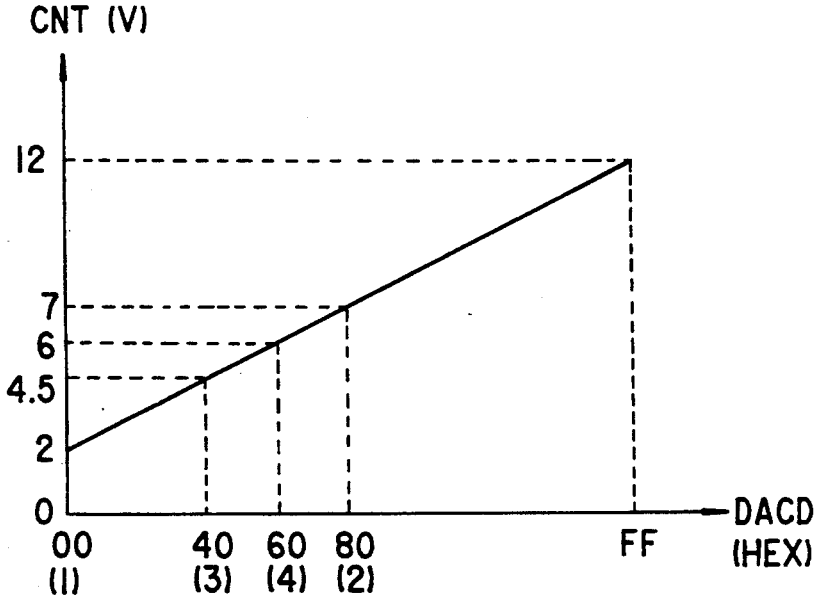
FIG. 8(*a*) shows the characteristics of the digital-to-analog converter illustrating the embodiment of the present invention.
Figure 8B:
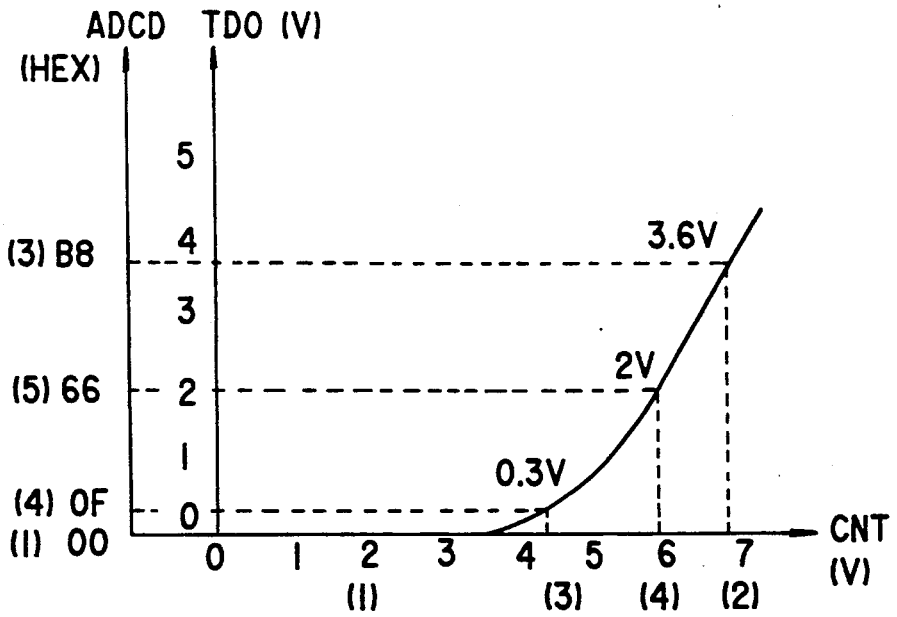

FIG. 8(*a*) shows the characteristic curve of DAC 40 copied from FIG. 5(*a*) to illustrate the example. FIG. 8(*b*) shows TDO (plotted from FIG. 4 for a developer with a permeability of 400 μm) and corresponding ADCD (referred to FIG. 5(*b*)) with respect to CNT voltages applied to sensor 3*b*.

(1) On detecting the "Change Completed" key pressed, controller 4*b* executes the "Sensitivity Control" processing": Motor M2 is started to rotate rollers 20, 21 and 22, DACD is set to "$ 00" and written in DAC 40 (which outputs a CNT of 2 v and causes sensor 3*b* to output a TDO of 0 v.). ΔDAC is set to "$ 80". Then, the timer is started designating 2 minutes.

When the designated time has elapsed, ADCD ("$ 00" for a TDO of 0 v) from ADC 41, and ΔD (=ADCD−ADCT="$ 00"−"$ 65"=−"$ 65") is computed.

Since |ΔD| is greater than ΔADC ("$ 05"), i.e., |ΔD| is beyond the allowable error and ΔD is less than zero, controller 4*b* executes the "Increase Sensitivity" subroutine in FIG. 7 (*b*). ΔDAC ("$ 80") is added to DACD ("$ 00") and the sum ("$ 80") is stored in memory 42 as a new DACD.

(2) Controller 4*b* executes the "Output Control Voltage" subroutine. DACD ("$ 80") is written in DAC 40 (which outputs a CNT of 7 v and causes sensor 3*b* to output a TDO of 3.6 v.), and the timer is started designating 5 seconds. Next, ΔDAC ("$ 80") is halved and ΔDAC/2( "$ 40") is stored in memory 42 as a new ΔDAC.

(3) When the designated time has elapsed, ADCD ("$ B8" for a TDO of 3.6 v) is read from ADC 41, ΔD (="$ B8"−"$ 65"="$ 53") is computed.

Since |ΔD| is greater than ΔADC and ΔD is greater than zero, controller 4*b* executes the "Decrease Sensitivity" subroutine in FIG. 7 (*a*). ΔDAC ("$ 40") is subtracted from DACD ("$ 80") and the difference ("$ 40") is stored in memory 42 as a new DACD.

Then, controller 4*b* executes the "Output Control Voltage" subroutine. DACD ("$ 40") is written in DAC 40 (which outputs a CNT of 4.5 v and causes sensor 3*b* to output a TDO of 0.3 v.) and the timer is started designating 5 seconds. Next, ΔDAC ("$ 40") is halved and ΔDAC/2 ("$ 20") is stored in memory 42 as a new ΔDAC.

(4) When the designated time has elapsed, ADCD ("$ 0F" for a TDO of 0.3 v) is read from ADC 41, ΔD (="$ 0F"−"$ 65" =−"$ 56") is computed.

Since |ΔD| is greater than ΔADC and ΔD is less than zero, controller 4*b* executes the "Increase Sensitivity" subroutine in FIG. 7 (*b*). ΔDAC ("$ 20") is added to DACD ("$ 40") and the sum ("$ 60") is stored in memory 42 as a new DACD.

Then, controller 4*b* executes the "Output Control Voltage" subroutine. DACD ("$ 60") is written in DAC 40 (which outputs a CNT of 6 v and causes sensor 3*b* to output a TDO of 2 v.) and the timer is stated designating 5 seconds. Next, ΔDAC ("$ 20") is is halved and ΔDAC/2 ("$ 10") is stored in memory 42.

(5) When the designated time has elapsed, ADCD ("$ 66" for a TDO of 2 v) is read from ADC 41, ΔD (="$ 66"−"$ 65"="$ ol") is computed.

Since |ΔD| is smaller than ΔADC ("$ 05"), i.e., within the allowable error, controller 4*b* stops operating developer station 2*b* and stores the current DACD ("$ 60") and ADCD ("$ 66") in the DACD and ADCT areas of memory 42 for use as the sensitivity control data and as the reference value ADCT, respectively.

As described above, since the correction value ΔADC is successively halved to determine a more accurate DACD value, the sensor output data ADCD can converge quickly to the reference value ADCT.

In the usual operation, when the developing unit is powered on, controller 4*b* reads out DACD from memory consisting, for example, of EEPROM (electrically erasable programmmable ROM) and writes the DACD in DAC 40 to apply the optimum sensitivity control voltage CNT to sensor 3*b*. In this state, the sensor output data ADCD is periodically read and compared with the value in the memory area ADCT, which is used as a threshold to determine the toner content. When the ADCD value is less than that in the ADCT, area controller 4*b* rotates toner feed roller 13 to replenish toner to developer station 2*b*.

In the above disclosure, sensor sensitivity (or sensitivity control voltage CNT) is determined so that the sensor output data ADCD falls within the predesignated allowable error ΔADC with the predesignated reference value ADCT at its center, and toner content is determined with the reference value ADCD obtained at this point as a threshold.

What is claimed is:

1. A toner content control apparatus which senses the toner content of developer in a developer station, compares the sensed toner content with a standard value, and replenishes toner in said developer station according to a result of comparison, said toner content control apparatus comprising:

sense means for sensing toner content of the developer and for outputting a signal indicating said toner content, said sense means having a sensitivity control circuit; and control means for determining an optimum sensor sensitivity control signal to b e applied to said sensitivity control circuit, with said optimum sensor sensitivity control signal said sense means gives an optimum sensor sensitivity and, said control means for designating as said standard value, the signal output from said sense means when said optimum sensor sensitivity control signal is applied to said sensitivity control circuit, wherein toner content is controlled with said optimum sensor sensitivity control signal which is applied to said sense means.

2. A toner content control apparatus according to claim 1, wherein said sense means senses toner content by measuring permeability of the developer.

3. A toner content control apparatus according to claim 1, wherein said control means determines said sensor sensitivity control signal and said standard value when said developer is changed.

4. A toner content control apparatus according to claim 1, wherein said control means includes (a) means for applying a sensor sensitivity control signal to said sensitivity control circuit, (b) means for obtaining a difference by subtracting a predesignated reference value from the signal output by said sense means, (c) means for updating said sensor sensitivity control signal by subtracting a correction signal from said sensor sensitivity control signal when said difference is beyond a predesignated allowable error and positive, and otherwise, by adding said correction signal to said sensor sensitivity control signal, and (d) means for determining an optimum sensor sensitivity control signal using said updated sensor sensitivity control signal and halving said correction signal until said difference comes within said allowable error.

5. A toner content control apparatus according to claim 4, wherein said control means determines said optimum sensor sensitivity control signal by designating an initial sensor sensitivity control signal to be zero and an initial correction value to be a half of a greatest possible value of said sensor sensitivity control signal.

6. A toner content control apparatus according to claim 1, wherein said control means comprises a digital computer, a digital-to-analog converter which converts digital data output from said digital computer to an analog sensor sensitivity control signal to be applied to said sense means, and an analog-to-digital converter which converts the signal output from said sense means to digital data to be input to said digital computer.

7. A toner content control apparatus which senses toner content of a developer including a carrier and a toner in a developer station, compares the sensed toner content with a standard value, and replenishes a toner in the developer station according to a result of the comparison, said toner content control apparatus comprising:

inputting means for inputting an instruction indicating that a developer has been changed in the developer station:

sensing means for detecting permeability of the developer in the developer station and for outputting a detecting signal indicating toner content of the developer, said sensing means providing a sensitivity which is adjustable by a control signal set in said sensing means;

setting means for setting a control signal, having a predetermined value in said sensing means, in accordance with the instruction input from said inputting means; and determination means for determining an optimum control signal for the supplied developer to be given to said sensing means based on the detecting signal output from said sensing means when the control signal having the predetermined value is set in said sensing means.

8. A toner content control apparatus according to claim 7, wherein said determination means comprising:

means for obtaining a difference by subtracting the standard value from the detecting signal output from said sensing means;

means for updating the control signal for the control signal generated by subtracting a correction signal from the control signal having been set in said sensing means when the difference is beyond limits of a predetermined error;

means for determining the control signal which has been set in said sensing means when the difference is within the limits of the predetermined error to be an optimum control signal to be given to said sensing means.

* * * * *